US009420906B2

(12) United States Patent
Fishbone

(10) Patent No.: US 9,420,906 B2
(45) Date of Patent: Aug. 23, 2016

(54) STACKABLE GLASS SET

(71) Applicant: Michael Fishbone, Briarcliff Manor, NY (US)

(72) Inventor: Michael Fishbone, Briarcliff Manor, NY (US)

( * ) Notice: Subject to any disclaimer, the term of this patent is extended or adjusted under 35 U.S.C. 154(b) by 0 days.

(21) Appl. No.: 14/492,434

(22) Filed: Sep. 22, 2014

(65) Prior Publication Data

US 2015/0305532 A1 Oct. 29, 2015

Related U.S. Application Data

(60) Provisional application No. 61/984,958, filed on Apr. 28, 2014.

(51) Int. Cl.
*A47G 19/23* (2006.01)
*A47G 19/22* (2006.01)

(52) U.S. Cl.
CPC ..... *A47G 19/2205* (2013.01); *A47G 19/2255* (2013.01); *A47G 19/23* (2013.01); *A47G 2400/10* (2013.01)

(58) Field of Classification Search
CPC ..... A47G 19/23; A47G 19/2255; A47G 2400/10
USPC ..... 220/703
See application file for complete search history.

(56) References Cited

U.S. PATENT DOCUMENTS

| | | | | |
|---|---|---|---|---|
| 2,239,093 | A | 4/1941 | Giller | |
| 2,347,658 | A | 5/1944 | Bourne | |
| 3,185,331 | A | 5/1965 | Loffelhardt | |
| 3,932,113 | A * | 1/1976 | Thrush | 431/297 |
| 4,428,145 | A | 1/1984 | Wheeler | |
| 4,872,569 | A * | 10/1989 | Bolte | 215/12.1 |
| 5,620,112 | A * | 4/1997 | Brown | 220/703 |
| 2008/0290102 | A1 | 11/2008 | Mangano | |
| 2013/0334166 | A1 | 12/2013 | Garipalli | |

* cited by examiner

*Primary Examiner* — Stephen Castellano
(74) *Attorney, Agent, or Firm* — Cozen O'Connor

(57) ABSTRACT

A stackable liquor glass has a bowl and a stem with set of equidistantly spaced holes to reduce vacuum pressure. In addition the stackable liquor glass includes a drainage passage, vented by the equidistantly placed holes for passage of fluid and air through a drainage pathway. The drain passage drains fluid through an asymmetric pathway for drainage outside of the glass through an opening in the glass. In addition a flat surface inside the bowl of the glass provides for a structure for the stacked glass to rest upon.

9 Claims, 3 Drawing Sheets

STACKABLE GLASS SET

RELATED APPLICATION

The present application is a non provisional application of provisional application Ser. No. 61/984,958 filed on Apr. 28, 2014 by Michael Fishbone.

BACKGROUND

1. Field

The present invention relates to a stackable liquor glass set. In particular the present invention relates to a stackable liquor glass set that provides for a reduction in vacuum pressure and for the release of liquid if the stacked glasses are wet in order to avoid glass breakage, scaring, and/or mold formation.

2. Related Art

Liquor glasses are typically stacked after being washed in restaurants and bars. One of the problems associated with stacking wet liquor glasses is that it can often lead to glass breakage due to the vacuum pressure formed by hot water vapor condensation within the stacked arrangement of glasses. It would be preferable to be able to design a liquor glass set that can be stacked in an aesthetically pleasing arrangement conducive to an attractive decor for a bar or a restaurant setting and which provide for fluid drainage and air circulation within each of the stacked glasses so as to avoid glass breakage, mold formation and excessive mineral deposits. It would be preferable to design a chalice that mimics the elegance of a classic snifter shape, while suiting the needs of a limited-space bar or restaurant, which might otherwise be unable to offer their guests proper stemware.

U.S. Pat. No. 2,239,153 to William relates to stacked cups that permit cleaning fluid to exit the interior of the cups through flutes and leave in the same manner.

U.S. Patent Publication 2008/290102 to Mongano discloses a wine glass with holes at the base of the bowl's interior for enhanced aeration of the wine during swirling.

It would be desirable to provide for a set of stackable liquor glasses that is structured to eliminate vacuum pressure in stacked arrangement and provide for liquid release to allow wet, hot glasses to be stacked without the risk breakage due to vacuum formation. It would also be desirable to design a set of liquor glasses that can be stacked in an aesthetically pleasing arrangement conducive to an attractive decor for a bar or a restaurant setting.

It would be desirable to provide a stackable set of glasses that can be stacked hot and wet in a stable structure, where the interior of the bowl of the top glass is not wedged against the exterior of the bottom glass, as is found in other stacked arrangements. Such stacked arrangements leave the glasses highly susceptible to surface scaring and cracking. Additionally, glasses that are stacked by means of wedging have yet to produce a shape attractive to connoisseurs of fine beverages.

SUMMARY

The present invention provides for a set of stackable liquor glasses in which each glass has in its stem, a set of equidistantly spaced holes (preferably four) to reduce vacuum pressure. In addition, the present invention provides a structure with a drainage passage, connected to the enclosure within the stem, vented by the four holes, for passage of fluid and air. The drain passage drains fluid through an asymmetric pathway for drainage outside of the glass. In addition, a flat surface surrounding the lowest point of the glass' interior provides for a receptacle for the stacked glass to rest upon.

DETAILED DESCRIPTION OF THE PREFERRED EMBODIMENT(s)

Figure 1:
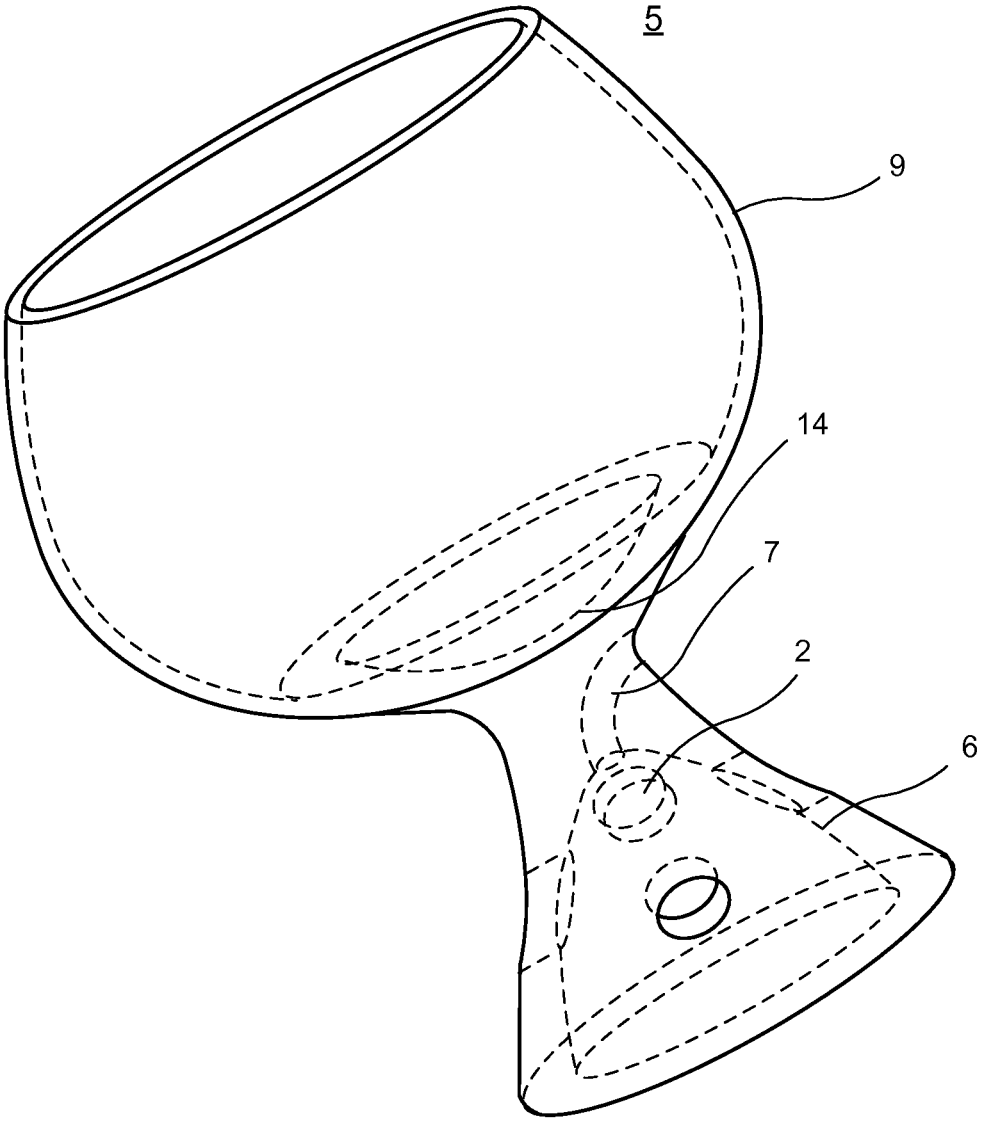
FIG. 1 is a perspective view of the present invention.
Figure 2:
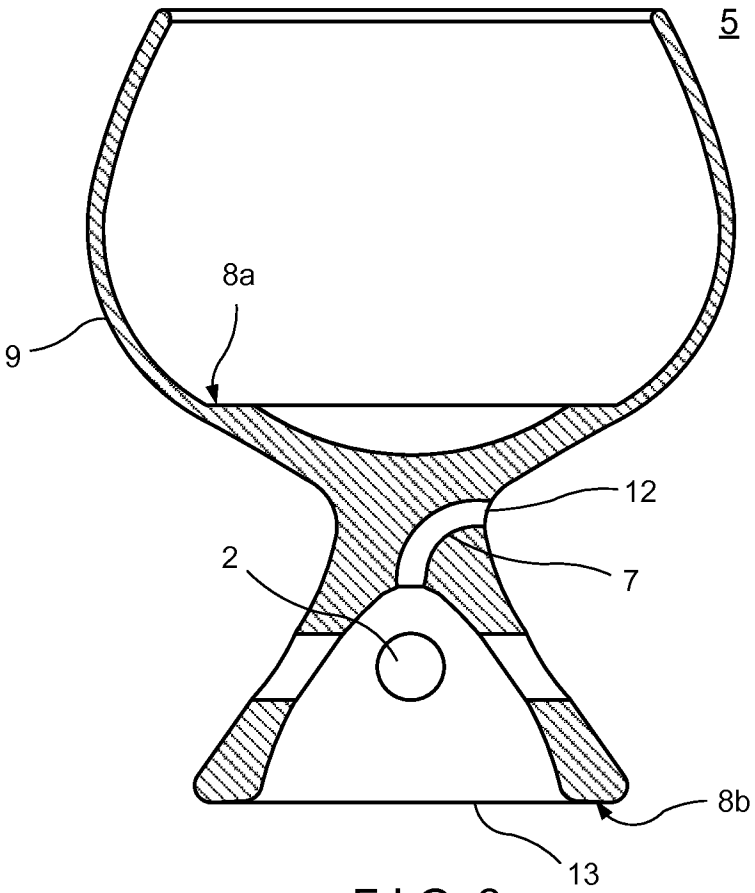
FIG. 2 is a sectional view of the present invention.

Referring to FIGS. 1-4 of the drawings, FIG. 1 is a perspective view of a stackable liquor glass 1 in accordance with the present invention. The stackable liquor glass 1 includes a stem 3 and a bowl 5. The bowl 5 is sealed off from the stem 3 of the glass 1 at a bottom surface 14 of the bowl 5 so that fluid in the bowl 5 does not pass into the stem 3. The stem 3 has an opening 13 at the bottom of the stem wherein residual washing/rinsing liquid collects when the glass 5 is stacked in an upside down arrangement as shown in FIG. 3A. Within the stem 3 is formed as an enclosure within the bottom portion of the glass 1 with the holes 2 placed equidistantly about the stem enclosure 6, each separated by 90 degrees of rotation. There are preferably four (4) holes 2 about the stem enclosure 6 of the glass 1 (see FIG. 2). The holes 2 eliminate vacuum formation caused by the stacking of the glasses 1 when the hot, wet glasses 1 cool to ambient temperature. The liquor glass 1 of the present invention also includes a drain 7 between the base 3 of the glass 1 and the bowl 5 (see FIG. 2). The drainage pathway links the enclosure 6 and an exit formed as a hole or opening 12 for liquid just beneath the bowl 5 when the glass 1 is in an upright position (conversely, located above the bowl in a stacked, upside-down arrangement (see FIGS. 2, 3 and 4). The drain 7 provides an asymmetric pathway or passage for residual rinsing water to exit the enclosure 6 through the opening 12 when the glass 1 is in its upside down stacked arranged position. The drain 7 is of ample diameter to avoid capillary action of residual rinsing water for borosilicate, commercial, and lead glass. FIG. 2 shows an individual glass 1 from a perspective view showing the drain 7 and one of the holes 2. As can be seen, the stem 3 is contained in the bottom portion of the glass 1 and has a set of holes 2 through which air can egress from the enclosure 6 through the holes 2 to outside of the glass 1.

Figure 3:
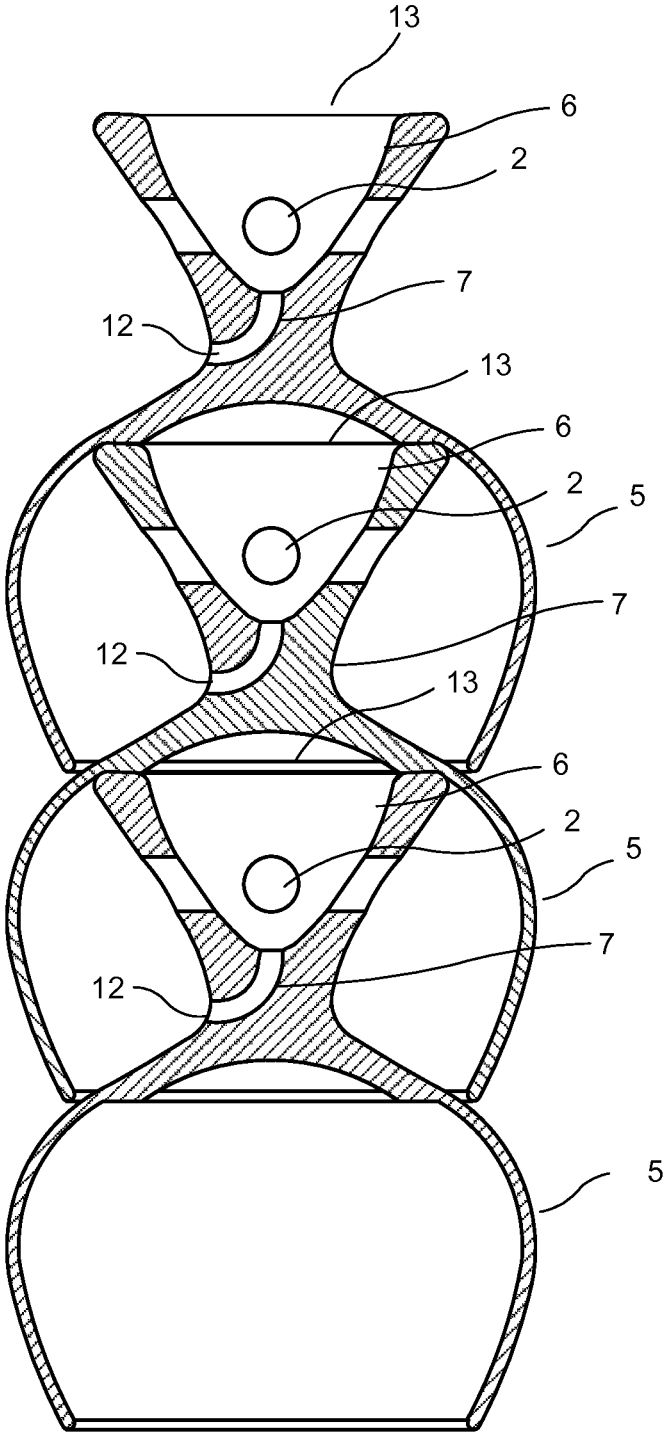
FIG. 3 shows the liquor glasses of the present invention in an upside-down stacked arrangement in sectional view.

In addition the liquor glass 1 of the present invention includes a flat surface 8*a* on which another of the stacked glasses 1 can rest its resting base 8*b* in stacked position on as can be seen in FIG. 3. The flat surface 8 acts as a shelf for the stacked glass 1 to rest upon.

FIG. 3 shows the glasses 5 of the present invention in a stacked arrangement where each glass rests in an upside down position on flat surface 8 of the glass of which it is housed inside. The flat surface 8 can be manufactured in one piece with the glass 1 or adhesively connected or otherwise bonded to the inside of the glass 1 as shown in FIG. 3.

Figure 4:
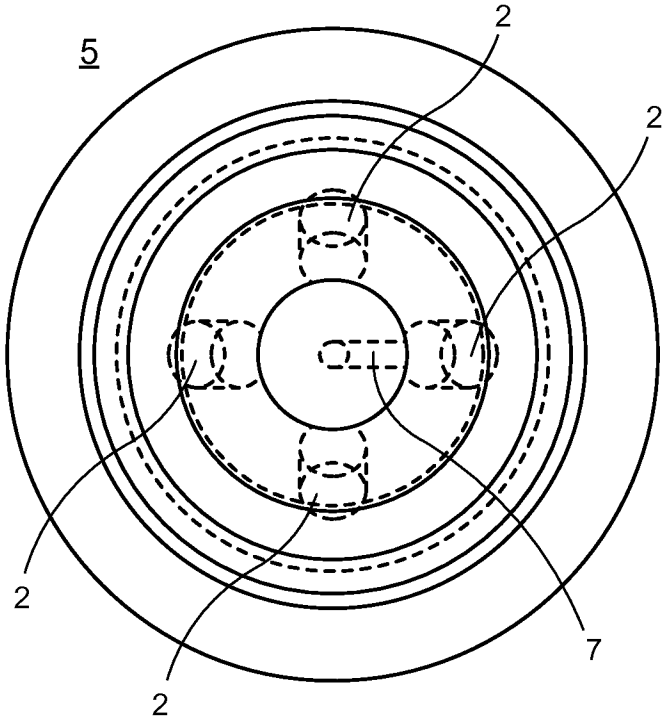
FIG. 4 shows a top view of FIG. 2 of the present invention.

FIG. 4 shows an individual one of the glasses 1 from a top view showing the drain 7 and the holes 2.

While presently preferred embodiments have been described for purposes of the disclosure, numerous changes to the arrangement of the apparatus' parts can be made by those skilled in the art. Such changes are encompassed within the spirit of the invention as defined by the appended claims.

What is claimed:

1. A glass comprising:

a bowl having a rim;

a hollow base coupled to the bowl at a first end and configured to support the bowl;

a ledge arranged in the bowl at a distance from the rim of the glass, the ledge configured to mate with a second end of the base;

at least one vent arranged in the hollow base and configured to provide a passage between an inside of the hollow base and an outer surface of the glass;

a stem arranged between the hollow base and the bowl;

at least one vent arranged to provide a passage through the stem;

at least two vents arranged in the wall of the hollow base;

wherein the distance from the rim of the glass to the ledge is greater than a height of the hollow base.

2. The glass of claim 1, wherein a diameter of the rim is greater than a diameter of the bowl at a point on the bowl that is equal to the distance from the rim of the glass to the ledge measured from the second end of the hollow base towards the rim.

3. The glass of claim 1, wherein the passage through the stem is asymmetric.

4. The glass of claim 1, wherein a plurality of vents are arranged in the wall of the hollow base.

5. The glass of claim 4, wherein the plurality of vents are equidistantly spaced.

6. A stackable glass, comprising:

a stem enclosure located in a bottom portion of the glass defining a hollow space;

a bowl; and a stem arranged between the stem enclosure and the bowl;

the stem enclosure having a plurality of holes that are equidistantly spaced apart from each other that eliminate a vacuum formation caused by an upside-down stacking arrangement of one or more of said glasses in a wet state;

the bowl including a flat surface for another glass to rest thereon when stacked within the glass, and a drain arranged in the stem having an outlet at a point just below the bowl on an external surface of the glass and an inlet into the hollow space formed by the stem enclosure configured to provide a passage for air and fluid to flow through the drain and out of an opening of the stem enclosure releasing air and water from the opening so as to avoid glass breakage.

7. The stackable glass according to claim 6 wherein the plurality of holes comprises four holes.

8. The stackable glass according to claim 6 wherein the plurality of holes are for ventilation.

9. The stackable glass according to claim 6 wherein the drain is an asymmetric drain that includes an opening for fluid egress from the drain at a point located just below the bowl for improved position or above the bowl in upside down stacked configuration.

* * * * *